US008017867B2

(12) United States Patent
Cho et al.

(10) Patent No.: US 8,017,867 B2
(45) Date of Patent: Sep. 13, 2011

(54) HIGHLY FOAMED COAXIAL CABLE

(75) Inventors: Bong Kwon Cho, Busan (KR); Sang Sik Shin, Daegu (KR); Jong Won Baek, Busan (KR)

(73) Assignee: LS Cable & System Ltd., Anyang, Gyeonggi-do (KR)

( * ) Notice: Subject to any disclaimer, the term of this patent is extended or adjusted under 35 U.S.C. 154(b) by 0 days.

(21) Appl. No.: 12/682,644

(22) PCT Filed: Oct. 13, 2008

(86) PCT No.: PCT/KR2008/006028

§ 371 (c)(1),
(2), (4) Date: Apr. 12, 2010

(87) PCT Pub. No.: WO2009/051378

PCT Pub. Date: Apr. 23, 2009

(65) Prior Publication Data

US 2010/0212935 A1 Aug. 26, 2010

(30) Foreign Application Priority Data

Oct. 15, 2007 (KR) ..... 10-2007-0103542
Aug. 13, 2008 (KR) ..... 10-2008-0079416

(51) Int. Cl.
*H01B 7/00* (2006.01)

(52) U.S. Cl. ..... 174/110 R; 174/110 F

(58) Field of Classification Search ..... 174/110 R, 174/110 F, 110 PM, 116, 120 R, 102 R, 24, 174/28

See application file for complete search history.

(56) References Cited

U.S. PATENT DOCUMENTS

| | | | | |
|---|---|---|---|---|
| 4,104,481 | A * | 8/1978 | Wilkenloh et al. | 174/28 |
| 4,107,354 | A * | 8/1978 | Wilkenloh et al. | 427/118 |
| 4,368,350 | A * | 1/1983 | Perelman | 174/102 D |
| 4,894,488 | A | 1/1990 | Gupta | |
| 5,110,998 | A * | 5/1992 | Muschiatti | 174/24 |
| 5,210,377 | A * | 5/1993 | Kennedy et al. | 174/107 |
| 5,959,245 | A | 9/1999 | Moe et al. | |
| 6,130,385 | A | 10/2000 | Tuunanen et al. | |
| 6,335,490 | B1 * | 1/2002 | Higashikubo et al. | 174/110 F |
| 6,492,596 | B1 * | 12/2002 | Higashikubo et al. | 174/137 B |
| 6,649,841 | B2 * | 11/2003 | Chopra et al. | 174/102 R |
| 6,858,805 | B2 * | 2/2005 | Blew et al. | 174/100 |
| 6,956,068 | B2 * | 10/2005 | Bufanda et al. | 521/79 |
| 7,541,542 | B2 * | 6/2009 | Park et al. | 174/102 R |
| 7,897,874 | B2 * | 3/2011 | Park et al. | 174/110 R |
| 2003/0044606 | A1 * | 3/2003 | Iskander | 428/375 |

FOREIGN PATENT DOCUMENTS

| | | | |
|---|---|---|---|
| JP | 08-203349 | A | 8/1996 |
| JP | 2004-063370 | A * | 2/2004 |
| KR | 10-0461263 | B1 | 2/2005 |
| WO | WO 97/45844 | A | 12/1997 |

* cited by examiner

*Primary Examiner* — William Mayo, III
(74) *Attorney, Agent, or Firm* — Sherr & Vaughn, PLLC

(57) ABSTRACT

A highly foamed coaxial cable having an inner conductor disposed in the cable, a foamed insulator having porous cells surrounding the inner conductor, an outer conductor surrounding the insulator, and a sheath surrounding the outer conductor and the insulator, wherein the total area of macro cell which has a diameter of at least 300/M is larger than the total area of micro cell which has a diameter smaller than 300/M at cross section of cable.

9 Claims, 6 Drawing Sheets

【Figure 4】
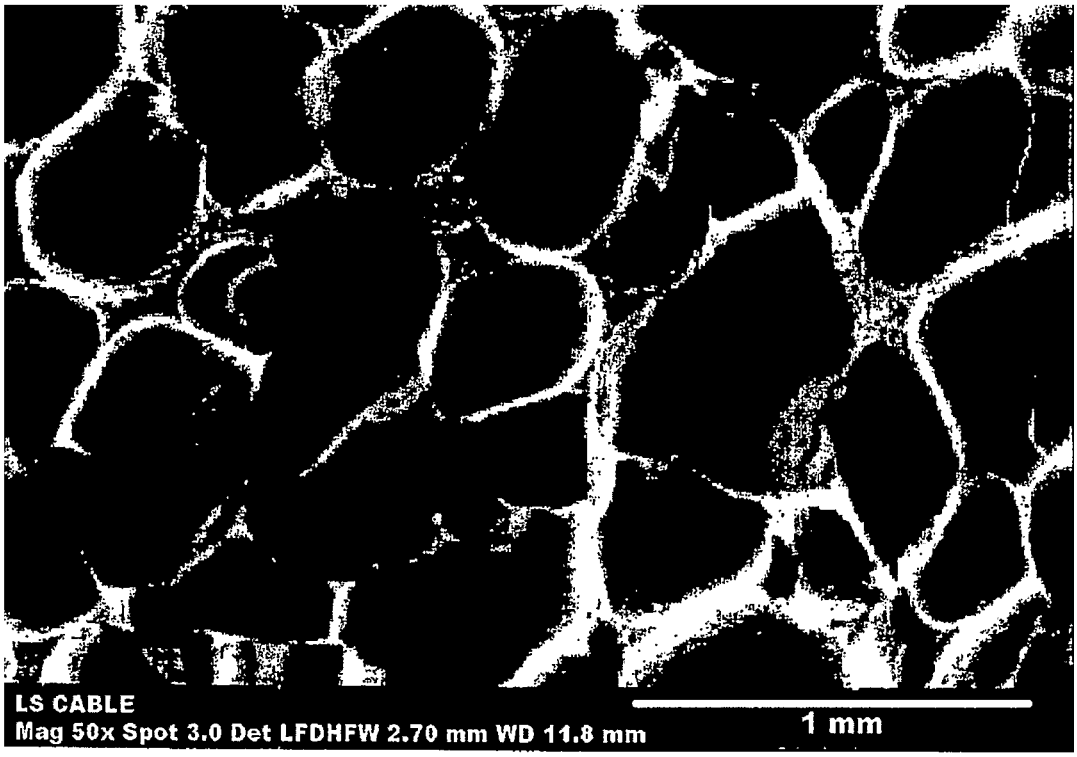

【Figure 5】
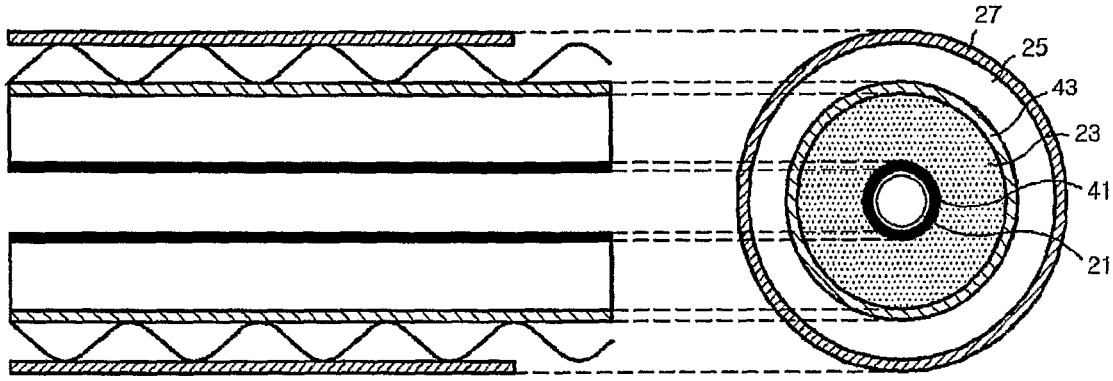

【Figure 6】
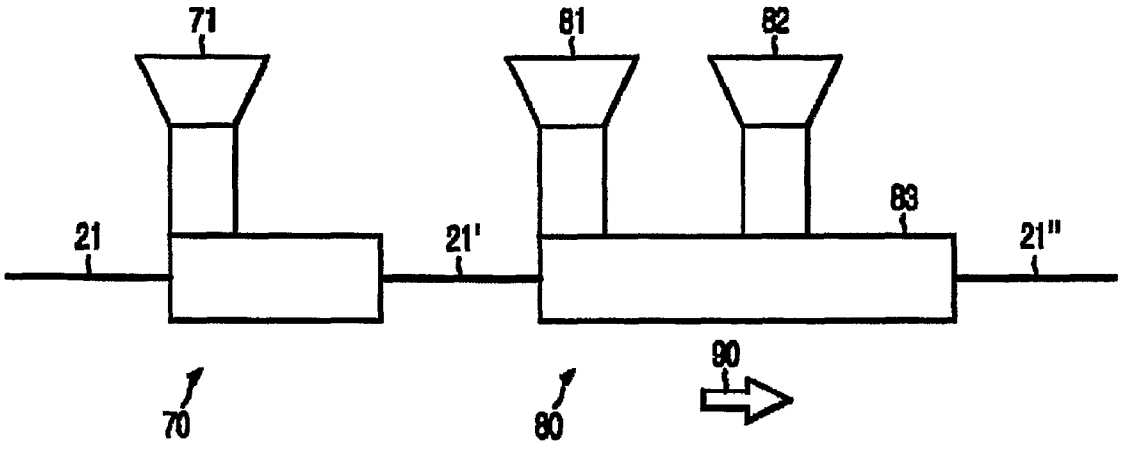

HIGHLY FOAMED COAXIAL CABLE

CROSS REFERENCE TO PRIOR APPLICATIONS

This application is a National Stage Patent Application of PCT International Patent Application No. PCT/KR2008/006028 (filed on Oct. 13, 2008) under 35 U.S.C. §371, which claims priority to Korean Patent Application Nos. 10-2007-0103542 (filed on Oct. 15, 2007) and 10-2008-0079416 (filed on Aug. 13, 2008), which are all hereby incorporated by reference in their entirety.

TECHNICAL FIELD

The present invention relates to coaxial cables, more particularly, highly foamed coaxial cable having stably increased foaming rate using macro cell, and by reason of the increased foaming rate, dielectric constant of the insulator can be decreased and signal transmission speed could be increased.

BACKGROUND ART

Recently, in wireless communication environment, coaxial cable has been used to transmit an ultra high frequency signals, because of coaxial cable's low signal attenuation characteristic.

More particularly, the coaxial cable has good characteristic, such as stabilized impedance, low signal attenuation characteristic, and excellent shielding property in high frequency band.

By reason of said high frequency characteristic, coaxial cable is suitable for high frequency communication cable which is used in base station of cellular phone using high frequency signal of microwave band.

In general, polymer material has been used as insulating material for surrounding copper wire.

In this case, if dielectric constant of insulating material decreases, then signal attenuation of cable decreases.

Therefore, developments and applications for materials of low dielectric constant have been continued in these days.

Currently, polyethylene resin has been applied for insulator, and especially, HDPE (High Density Polyethylene Resin) has been mostly used among various polyethylene resin.

On the other hand, FEP (Fluorinated Ethylene Propylene Resin) or etc. has been used for insulator among various fluororescein.

Among said materials, polyethylene resin is the best choice to make insulator of coaxial cable, because it has several advantages such as good physical properties, easy processing, and low cost.

But, by just using said materials, it is hard to transmit the signal to long distance with high speed and low signal loss rate.

Therefore, a chemical foaming method which foaming the mixture of chemical foaming agent and said materials, and a gas foaming method which foaming said materials with injected gas has been used to increase the signal transmission speed by decreasing the dielectric constant.

Here, due to the limitation of foaming skill, raising foaming rate of small size porous cell has been used to make insulator with low foaming density.

Referentially, to gain low dielectric constant, the technique of foaming a small cells which have diameter of 170 μm at most, and average diameter of the cell is from 90 to 130 μm with reduced density of foaming materials less than 0.22 g/cm$^3$, especially from 0.17 to 0.19 g/cm$^3$, is described in U.S. Pat. No. 6,037,545.

But, if traditional size of cell is used with extremely high foaming rate to decrease the foaming density, cell collapse or unbalanced external appearance can be occurred.

In this case, coaxial cable which produced by traditional foaming method is not suitable for long distance transmission with low signal loss, because of increased return loss of it.

DISCLOSURE OF INVENTION

Technical Problem

The purpose of the present invention is to solve above-described problems, and is to provide highly foamed coaxial cable with stably decreased foaming density, by using macro cell diameter of which is at least 300 μm in foaming process.

Another purpose of the present invention is to provide highly foamed coaxial cable with low signal loss for transmitting the signal to long distance, by improved foaming rate and reduced dielectric constant of insulator.

Another purpose of the present invention is to provide highly foamed coaxial cable by which it is possible to avoid undesired uniformity and return loss of the cable.

Technical Solution

To achieve said objects, A highly foamed coaxial cable according to present invention comprising, an inner conductor disposed in the cable, and a foamed insulator comprising porous cells and surrounding the inner conductor, and an outer conductor surrounding said insulator, and a sheath surrounding said outer conductor.

And, in said insulator, the total area of macro cell which has a diameter of at least 300 μm is larger than the total area of micro cell which has a diameter smaller than 300 μm at cross section of cable.

Preferably, the ratio of total area of macro cell to total cross sectional area of cable is from 63.6% to 92.0%.

And, the density of the insulator is from 0.05 g/cm$^3$ to 0.20 g/cm$^3$.

And, the foaming rate of said insulator is from 78.9% to 94.7%.

And, a relative dielectric constant of the insulator is from 1.085 to 1.291.

On the other hand, the ratio of cable signal transmission speed in the cable to signal transmission speed in the air is from 88% to 96%.

Preferably, said insulator is composed by gas foaming the mixture of 50~90 wt % of HDPE (High Density Poly Ethylene) and 10~50 wt % of LDPE (Low Density Poly Ethylene) and 0.1~3 wt % of nucleating agent.

And, an outer skin layer is further comprised to surround the insulator.

Advantageous Effects

By the present invention, it is possible to decrease foaming density stably by foaming macro cell with diameter of 300 μm at least in foaming process of insulator.

And, it is possible to transmit the signal to long distance with low signal loss, by improved foaming rate and reduced dielectric constant of insulator.

And, it is possible to avoid undesired uniformity and return loss of cable caused by collapse of the cell which occurs in high foaming rate with micro cells that have diameter less than 300 μm.

BRIEF DESCRIPTION OF THE DRAWINGS

The drawings attached illustrating the preferable embodiment of the present invention only helps further understanding of the idea of the present invention along with the detailed description of the present invention described in the below, and thus the present invention is not limitedly interpreted to the matters shown in the drawings.

FIG. 4 is fragmentary enlarged view of insulator of highly foamed coaxial cable according to present invention.

FIG. 5 shows cross sectional view in which of an inner skin layer and an outer skin layer are inserted into highly foamed coaxial cable according to present invention.

FIG. 6 is schematic view of a extruder producing highly foamed coaxial cable according to present invention.

EXPLANATION OF INDICATING MARKS OF FIGURE

Figure 1:
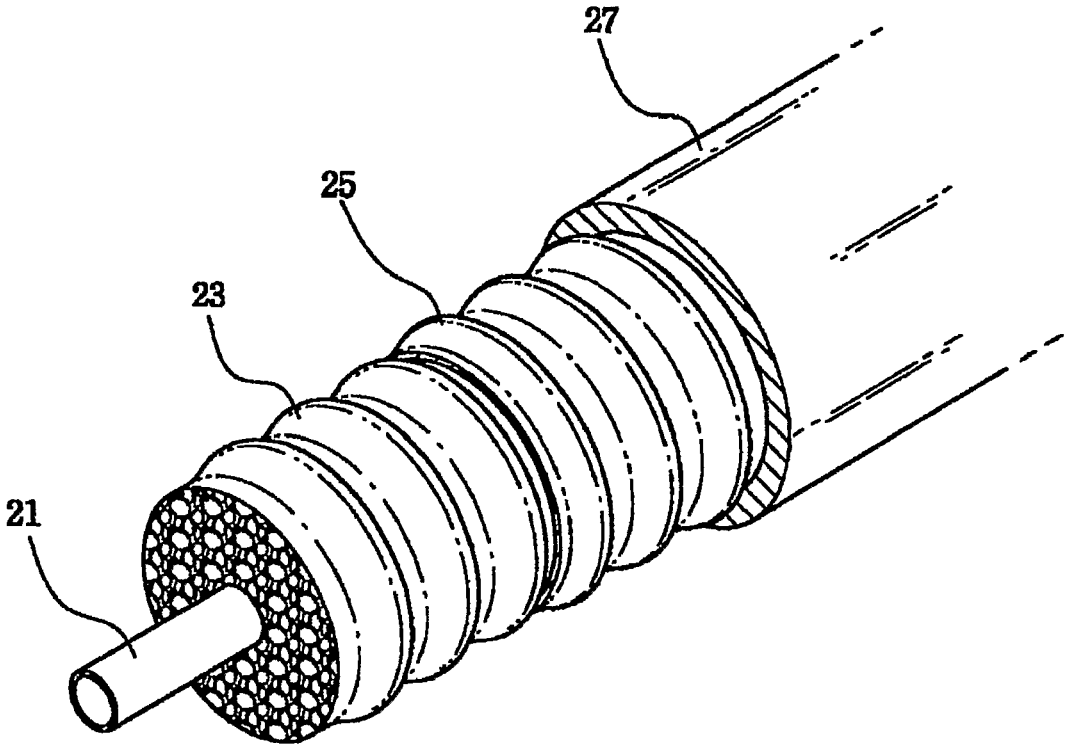
FIG. 1 is perspective view of highly foamed coaxial cable according to present invention.

21: inner conductor
23: insulator
25: outer conductor
27: sheath
30: cell
31: macro cell
32: micro cell
41: inner skin layer
43: outer skin layer

MODE FOR THE INVENTION

Hereinafter, the present invention is described in detail with reference to the attached drawings.

Before the detailed description, it should be noted that the terms used in the present specification and the claims are not to be limited to their lexical meanings, but are to be interpreted to conform with the technical idea of the present invention under the principle that the inventor can properly define the terms for the best description of the invention made by the inventor.

Therefore, the embodiments and the constitution illustrated in the attached drawings are merely preferable embodiments according to the present invention, and thus they do not express all of the technical idea of the present invention, so that it should be understood that various equivalents and modifications can exist which can replace the embodiments described in the time of the application.

Figure 2:
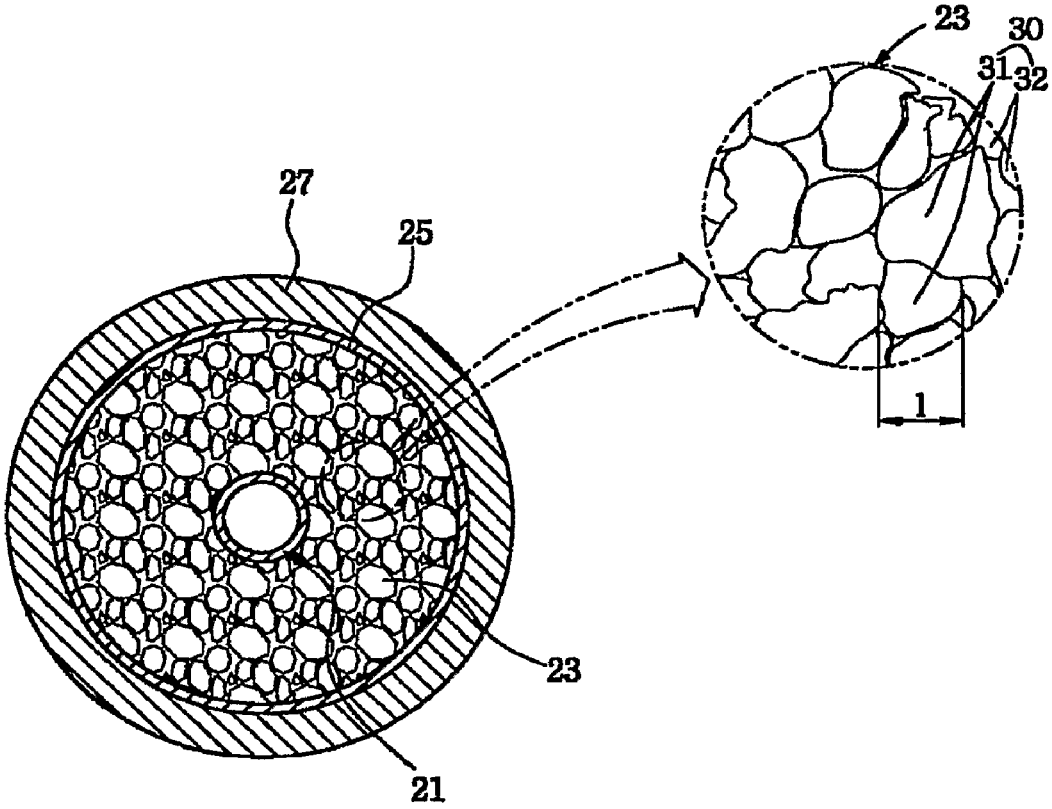
FIG. 2 is cross sectional view of highly foamed coaxial cable according to present invention.

FIG. 1 is perspective view of highly foamed coaxial cable according to present invention, and FIG. 2 is cross sectional view of highly foamed coaxial cable according to present invention.

Referring to FIG. 1 and FIG. 2, highly foamed coaxial cable according to present invention comprises, an inner conductor(21) disposed at center of the cable, and a foamed insulator(23) having porous cells and surrounding the inner conductor(21), and an outer conductor(25) surrounding the insulator, and a sheath(27) surrounding the outer conductor (25) and foaming external shape of the cable.

Said inner conductor(21) made of conducting material such as metal transmits the signals, and is disposed at the center of the cable.

Here, said inner conductor(21) can be foaming in various size, and it can have hollow structure at the center for improvement of flexibility and low cost of production.

And, said inner conductor(21) can be made of various metals such as copper or aluminum, especially, it can be made of copper or copper alloy which has good corrosion resistance and conducting property.

Besides, said outer conductor(25) prevents leakage of signal from the insulator(23), and shields the inner conductor (21) from alien crosstalk such as outer electronic waves.

By this reason, said outer conductor(25) can be made of conducting materials such as metal which has good shielding property.

Here, said outer conductor(25) can be made of various metals such as copper or aluminum, especially, it can be made of copper or copper alloy which has good corrosion resistance and conducting property.

And, said outer conductor(25) can be formed in cylindrical pipe appearance spaced away from the inner conductor(21) at regular interval, and it can have corrugate surface with regular pitch for flexibility of the cable.

Said insulator(23) is made from a insulating polymer, and it is disposed between said inner conductor(21) and outer conductor(25) for insulating and making distance between them.

Therefore, characteristic impedance is derived from dielectric constant of the insulator(23), and signal transmission speed is determined by said characteristic impedance.

$$\text{signal transmission speed} \propto \frac{1}{\sqrt{\text{dieletric constant}}} \qquad \text{[Formula 1]}$$

Here, transmission speed of signal transmitted by cable is inverse proportional to root of dielectric constant, as seen in Formula 1, so, if dielectric constant of insulator(23) decrease, transmission speed of signal increases.

Referring to FIG. 2, highly foamed coaxial cable according to present invention has insulator(23) made of foamed material which has many porous cell.

To improve the signal transmission speed, dielectric constant of insulator(23) has to be decreased, and low dielectric constant can be achieved by low foaming density of insulator (23) caused by high foaming rate.

Here, said foaming rate is ratio of air volume in unit volume of foamed material to unit volume of that.

Therefore, said foaming rate can be expressed as follows.

$$\text{foaming rate} = \frac{\text{air volume in foamed material}}{\text{volume of foamed material}} \times 100 \qquad \text{[Formula 2]}$$

Here, it is hard to measure the volume of air inside the foamed material, so, this formula can be converted to function of density.

So, it can be expressed as follows.

$$\text{foamingrate} = \left[1 - \frac{\text{density of foamed material}}{\text{density of original material}}\right] \times 100 \qquad \text{[Formula 3]}$$

In Formula 3, the density of foamed material can be measured from mass of foamed material and volume of foamed material.

Besides, volume of foamed material can be measured by sinking the foamed material in water.

Here, density of water is 1, so, increment of water volume is same as increment of water mass caused by sinking the foamed material.

Therefore, said density of foamed material can be expressed as follows.

$$\text{density of foamed material} = \frac{\text{mass of foamed material}}{\text{increment of water mass}} \quad \text{[Formula 4]}$$

Apply Formula 4 to Formula 3, we can have following formula.

$$\text{foaming rate} = \left[1 - \frac{\left(\frac{\text{mass of foamed material}}{\text{increment of water mass}}\right)}{\text{density of original material}}\right] \times 100 \quad \text{[Formula 5]}$$

Highly foamed coaxial cable according to present invention comprising the insulator(23) formed to have foaming rate from 78.9% to 94.7%.

Here, if foaming rate of insulator(23) is lower than 78.9%, like as seen in following embodiment which has foaming rate of 78.0%, improvement of signal transmission speed is weak.

And, if foaming rate of the insulator(23) is larger than 94.7%, insulator(23) can be mechanically weakened by high forming rate, and it cannot fix the relative position supporting the inner conductor(21) and outer conductor(25), so the space between the inner conductor(21) and the outer conductor(25) cannot be maintained.

Figure 3:
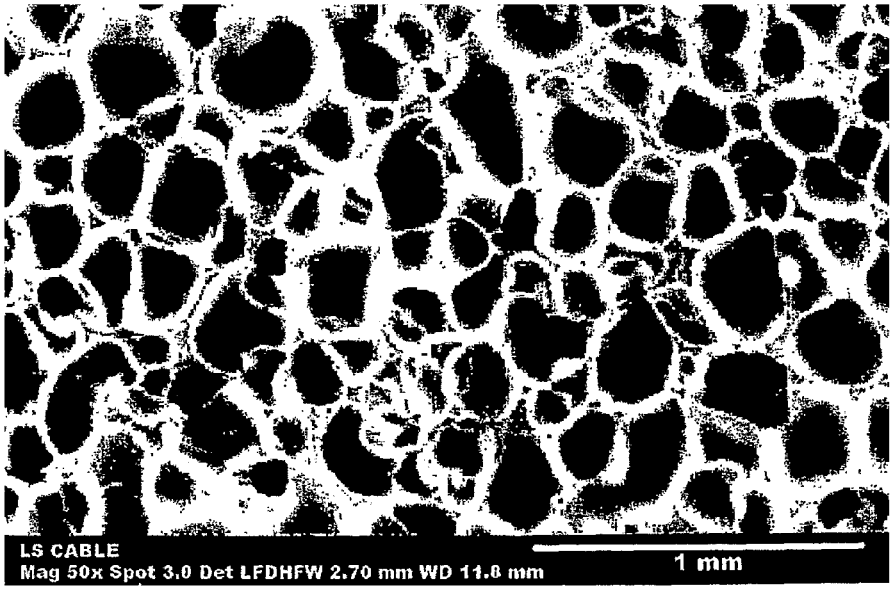
FIG. 3 Prior Art
FIG. 3 is fragmentary enlarged view of insulator of conventional coaxial cable.

On the other hand, FIG. 3 is fragmentary enlarged view in insulator of conventional coaxial cable, and FIG. 4 is fragmentary enlarged view in insulator(23) of highly foamed coaxial cable according to present invention.

Comparing FIG. 3 and FIG. 4, insulator(23) of highly foamed coaxial cable according to present invention has more macro cells(31) than insulator of conventional coaxial cable.

In present invention, while foaming macro cells(31) with foaming rate which is at least 78.9%, so it avoid undesired uniformity by cell collapse, and lessen return loss which can be occurred in conventional that comprises micro cells.

Here, what we call macro cell is the cell which has the largest diameter at least 300 μm, and what we call micro cell is the cell which has the largest diameter smaller than 300 μm.

As seen in FIG. 3 and FIG. 4, we can figure it out the macro cells(31) by micro scope, but it is hard to describe macro cells(31) by numerical values in the concrete.

So, in present invention, we describe the ratio of total area of macro cell(31) to area of cross section of cable.

And, it is possible to measure the ratio of macro cell(31)'s area through SEM (Scanning Electron Microscope) or microscope.

Here, in cross section of cable, if total area of macro cell (31) is smaller than area of micro cells(33), problem of undesired uniformity or return loss cannot be improved so much.

And, if ratio of macro cell(31)'s area is set to extremely high value, cells merge by cell collapse and it can consequentially weaken durability of the insulator(23).

Therefore, the ratio of macro cell(31)'s area in cross section of cable to total cross sectional area of the same is preferably 63.6% to 92.0%.

And, if the macro cells which has the largest diameter larger than 1000 μm take the greater part of insulator, it is hard to hold the figure of cable, so, ratio of macro cells which has the largest diameter larger than 1000 μm should be smaller than 10%.

Besides, because said insulator(23) is composed with foamed material having 78.9%~94.7% of foaming rate, density of said insulator(23) is formed in the range of 0.05 $g/cm^3$~0.2 $g/cm^3$.

And, by said range of density, relative dielectric constant of said insulator(23) is formed in the range of 1.085~1.291.

At this point, highly foamed coaxial cable according to present invention which has said range of relative dielectric constant can transmit the signal from 88% to 96% compared with aerial signal transmission speed.

This means speed improvement more than 1% compared with comparative example which has less than 87% of signal transmission speed.

In present invention, we use relative dielectric constant compared to dielectric constant of air 1, and express signal transmission speed as a ratio to aerial signal transmission speed (3×108 m/sec).

On the other hand, said insulator(23) can be composed by gas foaming the mixture of HDPE (High Density Poly Ethylene) and LDPE (Low Density Poly Ethylene) and nucleating agent.

Here, nitrogen gas($N_2$) and carbon dioxide($CO_2$) gas can be used for gas foaming, and especially, carbon dioxide gas is preferable for gas foaming by high foaming rate.

Because carbon dioxide gas has good solubility property and it is easy to compose the foamed material which has high foaming rate by using the same.

Besides, if only HDPE is used for composing said insulator (23), transmission property of cable is excellent, such as less signal loss, but it is hard to increase the foaming rate more than 80%.

And, if only LDPE is used for composing insulator(23), it is easy to increase the foaming rate more than 80%, but transmission property is bad.

Therefore, through mixing of the HDPE and the LDPE, it is possible to control the density and foaming rate of insulator (23).

On the other hand, said nucleating agent is an additive which promote the crystallization of mixed polymer of HDPE and LDPE, and it enhances the mechanical properties of insulator(23), and makes polymer crystal in minute size.

In other words, the crystallization speed and can be controlled by nucleating agent, and by this way, the cell(30) size can be controlled by nucleating agent, because said cell(30) is composed by polymer crystallization.

Inorganic additive such as talc, silica, kaolin and organic additive such as carboxylic acid and mono or polymer carboxylic acid can be act as said nucleating agent.

Here, said insulator(23) is composed by carbon dioxide gas foaming the mixture of 50~90 wt % HDPE (High Density Poly Ethylene) and 10~50 wt % LDPE (Low Density Poly Ethylene) and 0.1~3 wt % nucleating agent with 78.9% of foaming rate.

Besides, FIG. 5 shows cross sectional view of which an inner skin layer(41) and an outer skin layer(43) are inserted into highly foamed coaxial cable according to present invention.

Referring to FIG. 5, inner skin layer(41) can be positioned between inner conductor(21) and insulator(23), and an outer skin layer(43) can be inserted between insulator(23) and outer conductor(25).

Here, said inner skin layer(41) is a thin coating layer which increase the interface adhesion between inner conductor(21) and insulator(23), and it can be composed by polymer resin which is similar to materials of said insulator(23).

In the present invention, if said insulator(23) is composed by a polyethylene resin, preferably, the inner skin layer(41)

should be composed by polyolefin resin which has good compatibility to serve interfacing characteristic without influencing the dielectric characteristic of the insulator(23).

Here, said polyethylene resin can be one of HDPE, MDPE (Medium Density Poly Ethylene), LDPE, and LLDPE (Linear Low Density Poly Ethylene), or polymerized resin from at least one of HDPE, MDPE, LDPE, LLDPE.

And, said polyolefin resin can be polymerized resin comprising polyethylene or polypropylene or polyiosbutylene.

At this time, if the thickness of said thin coating layer is smaller than 0.01 mm, it is hard to make uniform coating on said inner conductor(21).

And if thickness of said thin coating layer is larger than 1 mm, dielectric constant of cable can be larger, so signal transmission speed can be decreased.

By this reason, thickness of said thin coating layer should be preferably from 0.01 mm to 1 mm, more preferably, it should be from 0.05 to 0.5 mm.

Besides, said outer skin layer(43) is positioned between insulator(23) and outer conductor(25), and it prevents excessive foaming of insulator(23) and collapse of foamed cells in the insulator(23).

And, said outer skin layer(43) can be composed by polymer resin which is similar to materials of said insulator(23), and if said insulator(23) is composed by a polyethylene resin, said polymer resin can be polyethylene, polypropylene, and PET (polyethyleneterephthalate) or polymerized resin from at least one of polyethylene, polypropylene, and PET.

Here, during production process of cable, outer skin layer (43) cool down faster than insulator(23) to suppress excessive foaming of insulator(23).

If thickness of outer skin layer(43) is smaller than 0.01 mm, cell collapse can be occurred.

And, if thickness of outer skin layer(43) is over than 0.5 mm, dielectric constant of cable can be larger, so, signal transmission speed can be decreased.

Therefore, thickness of said outer skin layer(43) should be preferably from 0.01 mm to 0.5 mm, more preferably, it should be from 0.5 to 0.3 mm.

When composing insulator(23), to increase foaming rate stably with macro cell, said materials of insulator have to be mixed by said mixing ratio, and materials for intermediate step for production the cable separate cooling process.

After extruding process of inner skin layer(41) on inner conductor(21), heat can be still remained in inner skin layer (41) of low thermal conductivity.

If foamed insulator(23) is laminated on the heat of inner skin layer(41) which is not cooled down enough, foamed cell of insulator(43) can collapse.

Therefore, said inner conductor(21) and inner skin layer (41) should be cooled down enough to prevent cell collapse of insulator(23) in a broad cooling zone with sufficient cooling time.

Here, said cooling zone can be processing equipment to cool down the incoming materials gradually or rapidly using water cooling system or air cooling system for high cooling efficiency.

This cooling zone can be prepared at following processing stage after extruding process of inner skin layer(41) and outer skin layer(43).

And, inside pressure of die nipple of extruder which extrudes insulator(23) on the inner skin layer should be decreased gently, because of high foaming rate of insulator (23) and for stable composing of macro cell Preferably, structure of said die nipple can be cylindrical form of which cross section diameter decreases gradually toward processing direction.

In the meanwhile, to increase the foaming rate of insulator (23) with macro cells, a pressure difference between inside and outside of extruder should be increased.

Therefore, said insulator(23) should stay at the cross head die of extruder for a long time, and amount of foaming gas and nucleating agent should be increased.

FIG. 6 is schematic view of a extruder for producing highly foamed coaxial cable according to present invention, and process for production highly foamed coaxial cable according to present invention is as follows, but not limited to this.

Referring to FIG. 6, after inner conductor(21) passes through the first extruder(70), it becomes the first linear member(21') on which inner skin layer(41) is positioned, and after the first linear member(21') passes through the second extruder(80), the first linear member(21') becomes the second linear member(21").

Here, said the first extruder(70) and the second extruder (80) can be strew type extruder or non-skrew type extruder, preferably, those can be a single shaft strew type extruder, but not limited to this.

First of all, said inner conductor(21) is made of copper, and it can have cylindrical form which has hollow structure in the center.

And, this inner conductor(21) is progressed to the proceeding direction(90) with appropriate speed, and it enter the first extruder(70) which has the first resin supplier(71).

Here, polyolefin resin can be supplied to said the first resin supplier(71).

The inner conductor(21) is supplied to the first extruder (70) for being laminated by inner skin layer(41) and extruded to the second to the second extruder(80).

At the first extruder(70), inner conductor(21) is coated by thin polyolefin resin film to make the first linear member(21').

Before the first linear member(21') enter the second extruder(80), the first linear member(21') can pass through the cooling zone which is next to the first extruder(70)(not figured).

Said the first linear member(21') is cooled down by water cooling or air spray to avoid insulator(23)'s cell collapse at the second extruder(80).

And, if water cooling method is used at the cooling zone, the first linear member(21') should have enough drying time to get rid of moisture which can exist at the surface of the first linear member(21') for preventing inferior production.

Next, at the second extruder(80), the first linear member (21') is laminated with insulator(23) and outer skin layer(43) through the extruding process.

The second extruder(80) has the second resin supplying part(81) and the third resin supplying part(82).

Here, HDPE and LDPE can be supplied to the second resin supplying part(81), and polymer resin for outer skin layer(43) can be supplied to the third resin supplying part(82).

And, insulator(23) and outer skin layer(43) are laminated on the inner conductor(21) by the double extruding process sequencely in the second extruder(70).

In other words, after the first linear member(21') is covered with foamed polyethylene, then polymer resin film in covered on the outside of foamed polyethylene resin in melted condition and it becomes the second linear member(21").

Here, said foaming can be achieved by mixed gas which is injected to melted state of polyethylene resin until the gas reached to supersaturation condition.

In embodiment of present invention, said outer skin layer (43) is cooled down rapidly while passing through the nozzle (83), to suppress the excessive foaming and for uniform composing of insulator(23)'s foamed cell.

Here, water cooling can be prepared for cooling method.

And, in the embodiment of present invention, inside of the second extruder(80) maintained above the temperature of 140° C. and pressure of 100 bar, and passing velocity of said first linear member(21') through the second extruder(80) is about 10 m/min.

After this, outer conductor(25) and sheath(27) are laminated on the second linear member(21") to make coaxial cable, but this technique is universally known, therefore detail explanation can be omitted.

Hereinafter, referring to Chart 1, comparison of embodiments of highly foamed coaxial cable according to present invention and conventional coaxial cable will be described.

CHART 1

| | Example 1 | Example 2 | Example 3 | comparative example 1 | comparative example 2 |
|---|---|---|---|---|---|
| foaming rate | 82% | 94.7% | 78.9% | 82% | 78% |
| density | 0.171 g/cm$^3$ | 0.05 g/cm$^3$ | 0.2 g/cm$^3$ | 0.17 g/cm$^3$ | 0.212 g/cm$^3$ |
| area ratio of macro cell | 85% | 92% | 63.6% | — | — |
| relative dielectric constant | 1.262 | 1.085 | 1.291 | 1.26 | 1.321 |
| signal transmission speed | 89% | 96% | 88% | 89% | 87% |
| external appearance of cable | uniformed | uniformed | uniformed | unbalanced | uniformed |
| return loss | 30 dB | 32 dB | 30 dB | 12 dB | 31 dB |

The signal transmission speed of Chart 1 is ratio of coaxial cable's signal transmission speed to speed of light.

And, comparative example 1 and comparative example 2 are composed by conventional coaxial cable production method, and while composing insulator, micro cells of which the largest diameter is smaller than 300 μm were used.

Besides, insulator of all the coaxial cables listed in chart 1 were composed by gas foaming the mixture of HDPE (High Density Poly Ethylene) and LDPE (Low Density Poly Ethylene) and nucleating agent, using carbon dioxide gas.

And, diameter of inner conductor of all the coaxial cables listed in chart 1 is 9.4 mm and made of copper, and outer diameter of insulator is 23.5 mm, and outer diameter of corrugated outer conductor is 25.2 mm, and thickness of inner skin layer is 0.15 mm, and thickness of outer skin layer is 0.1 mm.

Meanwhile, we can see that if foaming rate increases, then density and relative dielectric constant decreases, consequently, signal transmission speed increases.

EXAMPLE 1

The insulator(23) of the first exemplary highly foamed coaxial cable according to present invention has 85% of macro cell in the unit area of cable's cross section, 82% of foaming rate, 0.171 g/cm$^3$ of density, and 1.262 of relative dielectric constant.

Because macro cell is widely distributed in insulator by 85%, even though foaming process was maintained in condition of high foaming rate of 82%, external appearance of cable could be kept uniform.

By these characteristics, example 1 has 89% of signal transmission speed and 30 dB of return loss, and this property is good for communication cable.

But, coaxial cable according to comparative example 1 has 82% of foaming rate, 0.17 g/cm$^3$ of density, 1.26 of relative dielectric constant, and 89% of signal transmission speed which is similar to example 1.

But, external appearance of coaxial cable according to comparative example 1 was unbalanced, and by this reason, it had 12 dB of return loss.

EXAMPLE 2

The insulator(23) of second examplary highly foamed coaxial cable according to present invention has 92% of macro cell in the unit area of cable's cross section, 94.7% of foaming rate, 0.05 g/cm$^3$ of density, and 1.085 of relative dielectric constant.

Because macro cell is widely distributed in insulator by 92%, even though foaming process was maintained in condition of high foaming rate of 94.7%, external appearance of cable could be kept uniform.

In this condition, example 2 had 96% of signal transmission speed and 32 dB of return loss, and this property is excellent for communication cable.

EXAMPLE 3

The insulator(23) of third examplary highly foamed coaxial cable according to present invention has 63.6% of macro cell in the unit area of cable's cross section, 78.9% of foaming rate, 0.2 g/cm$^3$ of density, and 1.291 of relative dielectric constant.

Because macro cell is widely distributed in insulator by 63.6%, even though foaming process was maintained in condition of high foaming rate of 78.9%, external appearance of cable could be kept uniform.

Besides, coaxial cable according to comparative example 2 has 78% of foaming rate, 0.212 g/cm$^3$ of density, 1.321 of relative dielectric constant, and it's properties is similar to example 3.

Comparing example 3 and comparative example 2, return loss of two cables are similarly 30 dB and 31 dB, but signal transmission speed of example 3 is 88% that is faster than signal transmission speed of comparative example 2.

And comparative example 1 and comparative example 2, as seen in comparative example 2, we can see that if foaming rate is low, external appearance of cable and return loss is not so bad.

But, as seen in comparative example 1, if foaming rate is increased to gain high signal transmission speed when the insulator is composed by conventional producing method, undesired uniformity of cable and return loss can be a significant matter.

Consequently, insulator should be foamed in the foaming rate larger than 78.9% to obtain high signal transmission speed and low return loss, and ratio of macro cell in the unit area of cable's cross section should be increased to increase the foaming rate stably.

Although the present invention has been described with reference to the specified examples in the above, but the idea of the present invention is not limited to the above described matters and various changes and modifications can be made within the equivalent scope of the present invention and the following claims by the ordinary-skilled person of the art.

The invention claimed is:

1. A highly foamed coaxial cable comprising:

an inner conductor disposed in the cable;

a foamed insulator comprising porous cells and surrounding the inner conductor, wherein the total area of macro cells with a diameter of at least 300 μm is larger than the total area of micro cells with a diameter smaller than 300 μm in a cross section of cable;

an outer conductor surrounding said insulator; and a sheath surrounding said outer conductor.

2. The highly foamed coaxial cable according to claim 1, wherein, the percentage of the total area of macro cells in a total cross sectional area of cable is between 63.6% to 92.0%.

3. The highly foamed coaxial cable according to claim 2, wherein the density of the insulator is between 0.05 g/cm$^3$ and 0.20 g/cm$^3$.

4. The highly foamed coaxial cable according to claim 3, including an outer skin layer which surrounds the insulator.

5. The highly foamed coaxial cable according to claim 3, wherein, the foaming rate of said insulator is between 78.9% and 94.7%.

6. The highly foamed coaxial cable according to claim 5, wherein a relative dielectric constant of the insulator is between 1.085 and 1.291.

7. The highly foamed coaxial cable according to claim 6, wherein, the percentage of signal transmission speed in the cable with respect to signal transmission speed in the air is between 88% and 96%.

8. The highly foamed coaxial cable according to claim 7, wherein said insulator is composed by gas foaming the mixture of 50~90 wt % of High Density Poly Ethylene, 10~50 wt % of Low Density Poly Ethylene, and 0.1~3 wt % of nucleating agent.

9. The highly foamed coaxial cable according to claim 1, wherein said insulator is composed by gas foaming the mixture of 50~90 wt % of High Density Poly Ethylene, 10~50 wt % of Low Density Poly Ethylene, and 0.1~3 wt % of nucleating agent.

* * * * *